US006957864B2

(12) United States Patent
Chen

(10) Patent No.: US 6,957,864 B2
(45) Date of Patent: Oct. 25, 2005

(54) CHAIR WITH A STOPPING DEVICE

(76) Inventor: Su-Ming Chen, No. 566, Fong-Lin 2nd Rd., Ta-Liao Hsiang, Kaohsiung Hsien (TW)

( * ) Notice: Subject to any disclaimer, the term of this patent is extended or adjusted under 35 U.S.C. 154(b) by 152 days.

(21) Appl. No.: 10/683,139

(22) Filed: Oct. 9, 2003

(65) Prior Publication Data

US 2005/0077768 A1 Apr. 14, 2005

(51) Int. Cl.[7] ..... A47C 7/60

(52) U.S. Cl. ..... 297/302.5; 297/302.7; 297/300.6; 297/301.5

(58) Field of Search ..... 297/300.1, 300.6, 297/300.7, 300.8, 301.1, 301.5, 301.6, 301.7, 302.1, 302.5, 302.6, 302.7

(56) References Cited

U.S. PATENT DOCUMENTS 4,555,085 A * 11/1985 Bauer et al. ..... 248/561
5,997,087 A * 12/1999 Stumpf ..... 297/327
6,116,688 A * 9/2000 Wilkerson et al. ..... 297/316
6,378,943 B1 * 4/2002 Beggs et al. ..... 297/325
6,394,550 B1 * 5/2002 Liu ..... 297/374
6,588,843 B1 * 7/2003 Ebenstein ..... 297/300.1
6,598,936 B1 * 7/2003 Klein ..... 297/301.2
6,779,847 B2 * 8/2004 Klein ..... 297/301.2

* cited by examiner

*Primary Examiner*—Peter M. Cuomo
*Assistant Examiner*—Stephen D'Adamo
(74) *Attorney, Agent, or Firm*—Ostrolenk, Faber, Gerb & Soffen, LLP

(57) ABSTRACT

A chair includes an upper frame disposed above and pivoted to a lower frame. A stopping device includes a slide mounted slidably on the upper frame, and a stopping member. The slide is slidable between a first position, where the stopping member is offset from a rear plate of the lower frame in a longitudinal direction, and a second position, where the stopping member is aligned with the rear plate in a vertical direction. A cam mechanism includes a cam connected movably to side plates of the lower frame and a cam follower formed on the slide and engaging the cam in such a manner that movement of the cam from a releasing position to a restricting position results in movement of the slide from the first position to the second position.

8 Claims, 8 Drawing Sheets

CHAIR WITH A STOPPING DEVICE

BACKGROUND OF THE INVENTION

1. Field of the Invention

The present invention relates to a chair, more particularly to a chair with a stopping device for preventing tilting of a seat relative to a leg unit.

2. Description of the Related Art

Referring to FIGS. 1 and 2, a conventional chair 1 is shown to include a leg unit 11, a base frame 13, a top frame 14, a backrest-supporting frame 15, and a positioning unit 2.

As illustrated, the base frame 13 has opposite front and rear ends, a bottom plate 132 mounted securely on the leg unit 11, and two side plates 131 extending upwardly from two opposite sides of the bottom plate 132. The top frame 14 is disposed above the base frame 13, and includes a seat-supporting plate 142, and two side plates 141 that extend downwardly from two opposite sides of the seat-supporting plate 142 and that are pivoted respectively to the side plates 131 of the base frame 13 through a first pivot 16 so as to permit pivotal action the top frame 14 relative to the base frame 13. A cushion seat 120 is mounted on the seat-supporting plate 142 of the top frame 14. An urging mechanism 19 is mounted on the base frame 13, and urges the front end of the bottom plate 132 toward the top frame 14.

The backrest-supporting frame 15 is disposed rearwardly of the base frame 13, and includes two side plates 151 pivoted respectively to the side plates 131 of the base frame 13 through a second pivot 18, and to two lugs 143 formed on the side plates 141 of the top frame 14 through a third pivot 17 such that the second and third pivots 18, 17 are disposed rearwardly of and are parallel to the first pivot 16. A backrest 10 can be mounted on the backrest-supporting frame 15.

The positioning unit 2 includes a control rod 22 and a stopping member 21 that has a tubular portion 212 defining a retention hole 213 and an annular flange 211 extending radially and outwardly from the tubular portion 212 and welded to an inner one of the side plates 141 of the top frame 14. The control rod 22 extends slidably through two holes 133 in the side plates 131 of the base frame 13, and is movable between a locking position, in which an engaging end 223 of the control rod 22 engages the retention hole 213 in the stopping member 21 so as to prevent the top frame 14 from tilting relative to the base frame 13, and a releasing position, in which the engaging end 223 of the control rod 22 disengages the stopping member 21 so as to permit tilting of the top frame 14 relative to the base frame 13.

Disadvantages of the conventional chair reside in that welding of the stopping member 21 to the inner side plate 141 of the top frame 14 is difficult to conduct, and that alignment of the retention hole 213 with the holes 133 is not easy. Moreover, since the diameter of the holes 133 is required to be approximate to that of the control rod 22, operation of the control rod 22 to extend the engaging end 223 into the retention hole 213 is not smooth. Besides, the engaging end 223 of the control rod 22 tends to deform after a period of use.

SUMMARY OF THE INVENTION

Therefore, the object of this invention is to provide a chair with a stopping device so as to overcome the aforesaid disadvantage of the prior art.

According to the present invention, a chair includes: a leg unit; a lower frame having opposite front and rear ends, a base plate secured to the leg unit, spaced-apart side plates extending between the front and rear ends in a longitudinal direction, and a rear plate extending upwardly from the base plate and having an upper end; a first pivot extending in a transverse direction relative to the longitudinal direction; an upper frame including a seat-mounting plate disposed above the lower frame, and two side plates that extend downwardly and respectively from two opposite sides of the seat-mounting plate and that are respectively pivoted to the side plates of the lower frame through the first pivot so as to permit pivotal action of the upper frame relative to the lower frame, the seat-mounting plate being spaced apart from the upper end of the rear plate in a vertical direction that is transverse to the longitudinal and transverse directions; an urging mechanism connected to the front end of the seat-mounting plate of the upper frame and the lower frame; and a stopping device including a slide mounted slidably on the seat-mounting plate, and a stopping member formed on the slide, the slide being slidable in the longitudinal direction between a first position, in which the stopping member is offset from the rear plate of the lower frame in the longitudinal direction, and a second position, in which the stopping member is aligned with the rear plate of the lower frame in the vertical direction for preventing pivoting of the upper frame relative to the lower frame, the stopping device further comprising a cam mechanism which includes a cam that is connected movably to the side plates of the lower frame and that is movable in the transverse direction between a releasing position, and a restricting position, and a cam follower that is formed on the slide and that engages the cam in such a manner that movement of the cam from the releasing position to the restricting position results in movement of the slide from the first position to the second position, and that movement of the cam from the restricting position to the releasing position results in movement of the slide from the second position to the first position.

BRIEF DESCRIPTION OF THE DRAWINGS

Other features and advantages of this invention will become more apparent in the following detailed description of the preferred embodiment of this invention, with reference to the accompanying drawings, in which.

DETAILED DESCRIPTION OF THE PREFERRED EMBODIMENT

Figure 1:
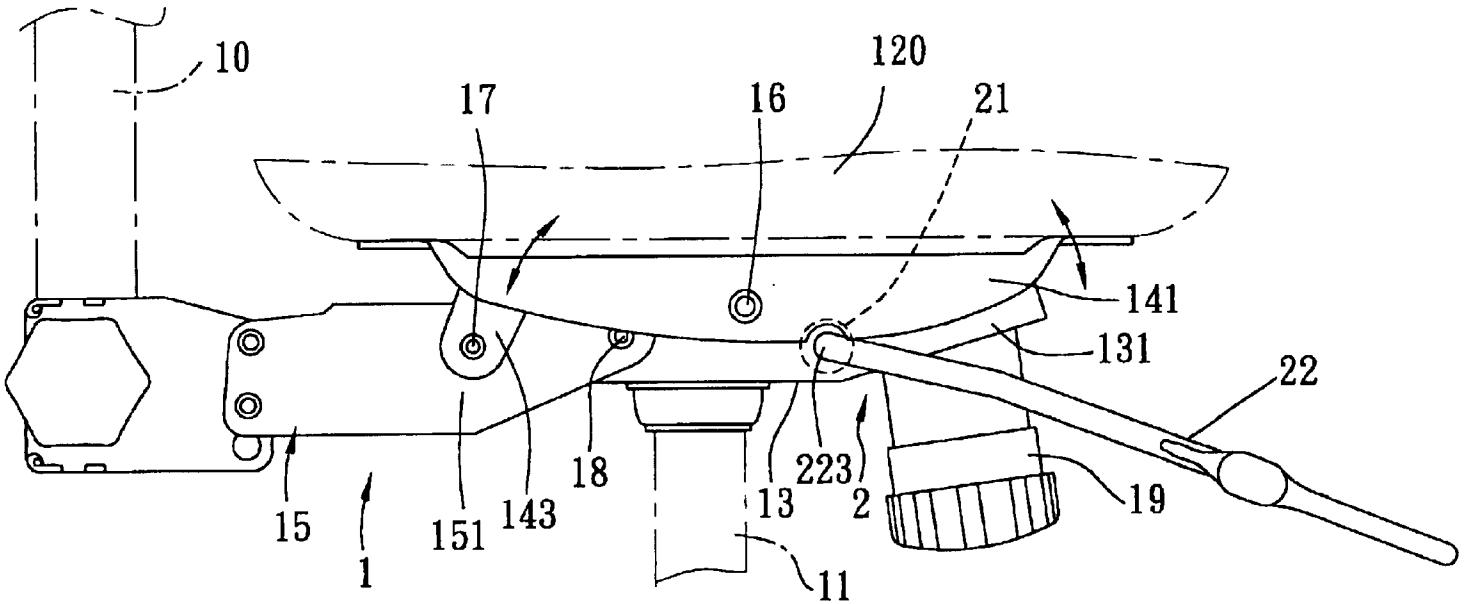
FIG. 1 PRIOR ART
FIG. 1 is a schematic side view of a conventional chair.
Figure 2:
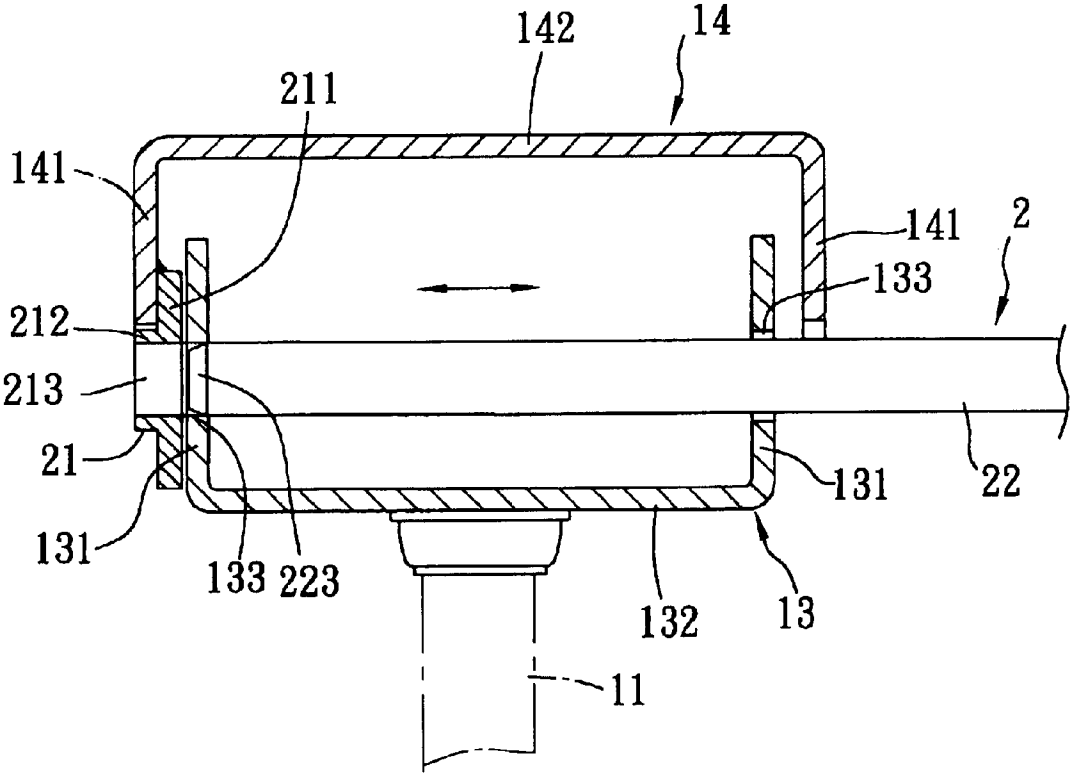
FIG. 2 PRIOR ART
FIG. 2 is a fragmentary sectional view illustrating a top frame, a base frame and a position of the conventional chair.
Figure 3:
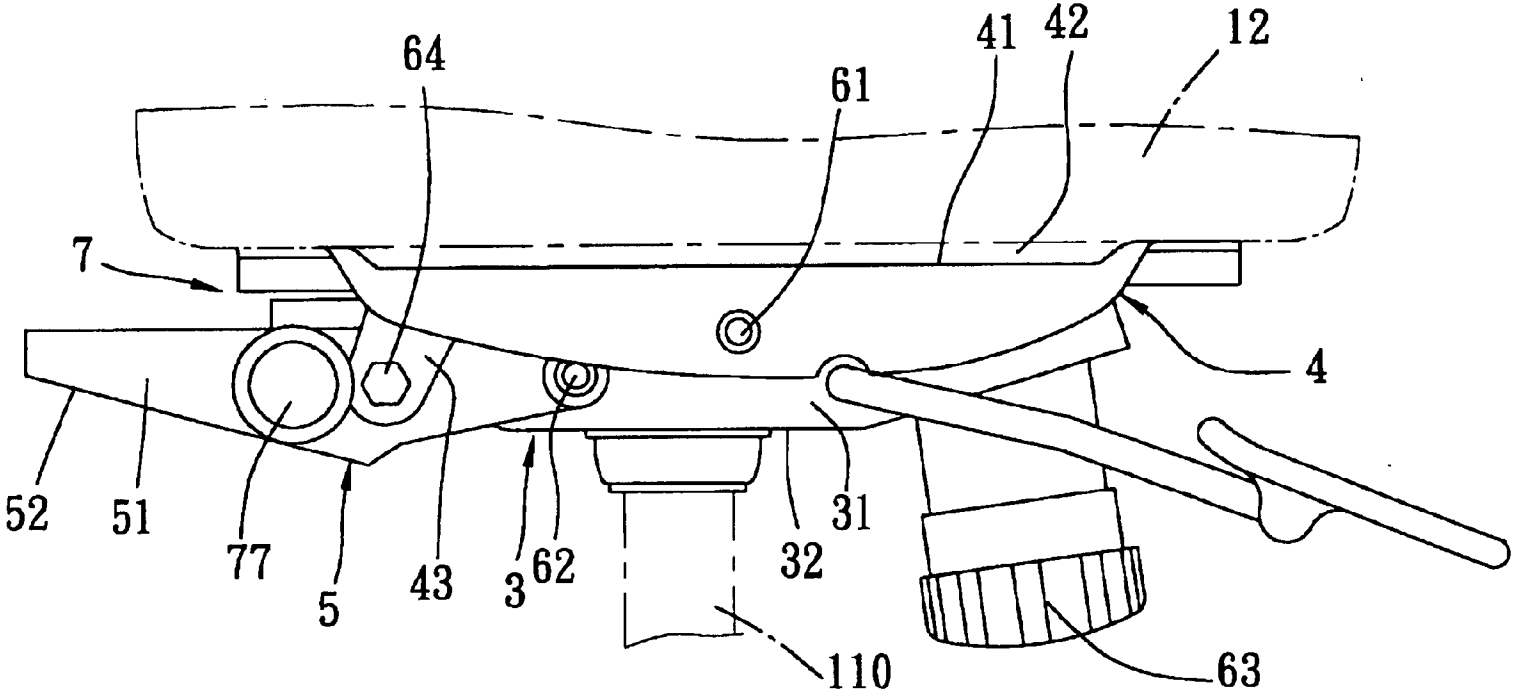
FIG. 3 is a schematic fragmentary side view of the preferred embodiment of a chair according to the present invention.
Figure 4:
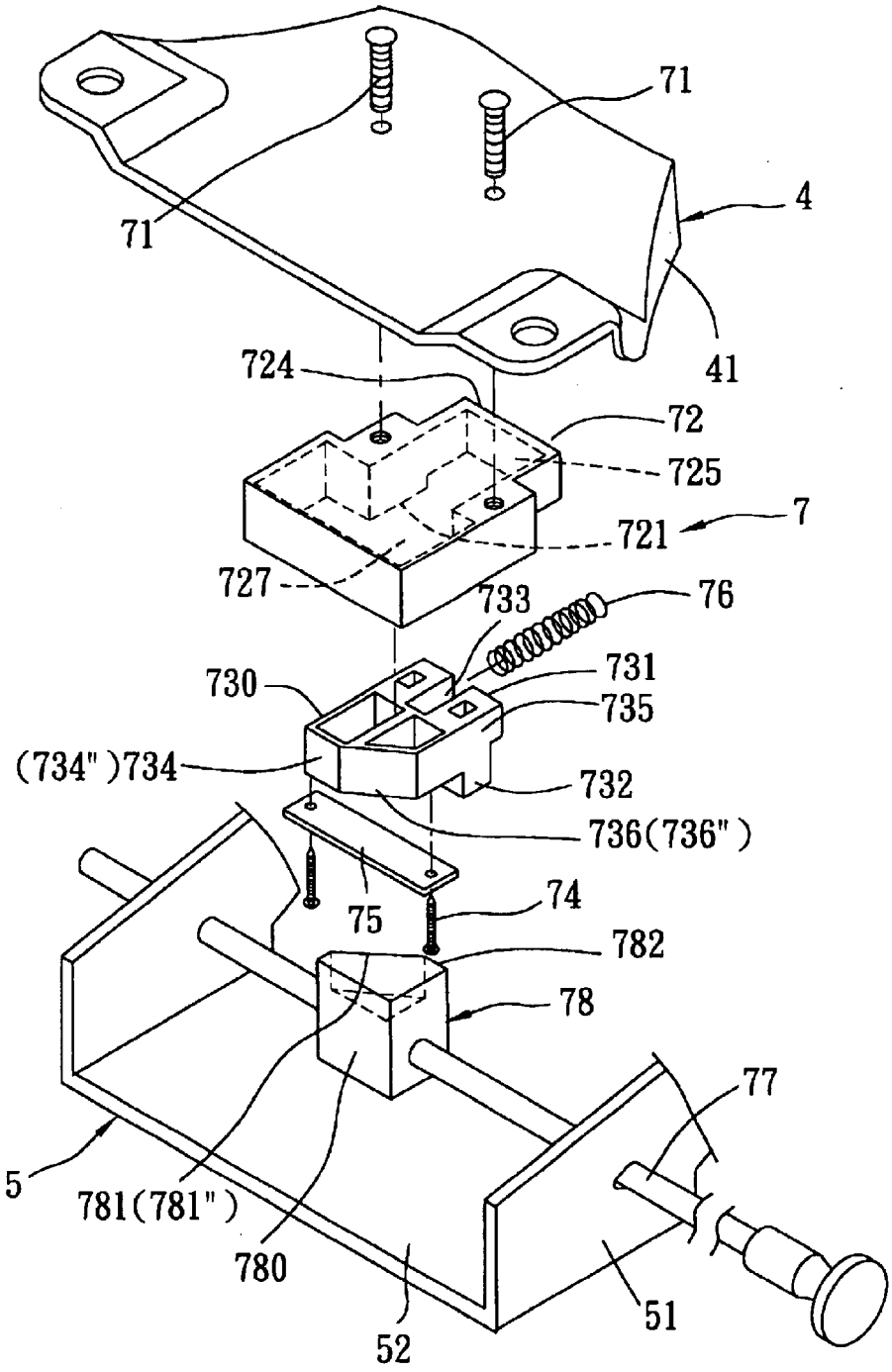
FIG. 4 is a fragmentary exploded perspective view and an upper frame of the preferred embodiment.

Referring to FIGS. 3 to 6, the preferred embodiment of a chair according to the present invention is shown to include a leg unit 11, a U-shaped lower frame 3, first, second and third pivots 61, 62, 64, an inverted U-shaped upper frame 4, an urging mechanism 63, and a stopping device 7.

The leg unit 11 can include a hydraulically or pneumatically operated cylinder device.

The lower frame 3 has opposite front and rear ends, and includes a base plate 32 secured to a top end of the leg unit 110, spaced-apart side plates 31 extending between the front and rear ends in a longitudinal direction, and a rear plate 33 extending upwardly from the base plate 32. The rear plate 33 has an upper end 331.

The first pivot 61 extends in a transverse direction relative to the longitudinal direction.

The upper frame 4 includes a seat-mounting plate 42 disposed above the side plates 31 of the lower frame 3, and two side plates 41 that extend downwardly and respectively from two opposite sides of the seat-mounting plate 42 and that are pivoted respectively to the side plates 31 of the lower frame 3 through the first pivot 61 so as to permit pivotal action of the upper frame 4 relative to the lower frame 3. A seat member 12 is mounted on the seat-mounting plate 42 of the upper frame 4 to permit sitting of a person thereon. The seat-mounting plate 42 is spaced apart from the upper end 331 of the rear plate 33 by a gap 44 in a vertical direction that is transverse to the longitudinal and transverse directions.

The urging mechanism 63 is connected to the lower frame 3 and the front end of the seat-mounting plate 42 in such a manner that the gap 44 is formed between the seat-mounting plate 42 and the upper end 331 of the rear plate 33.

Figure 5:
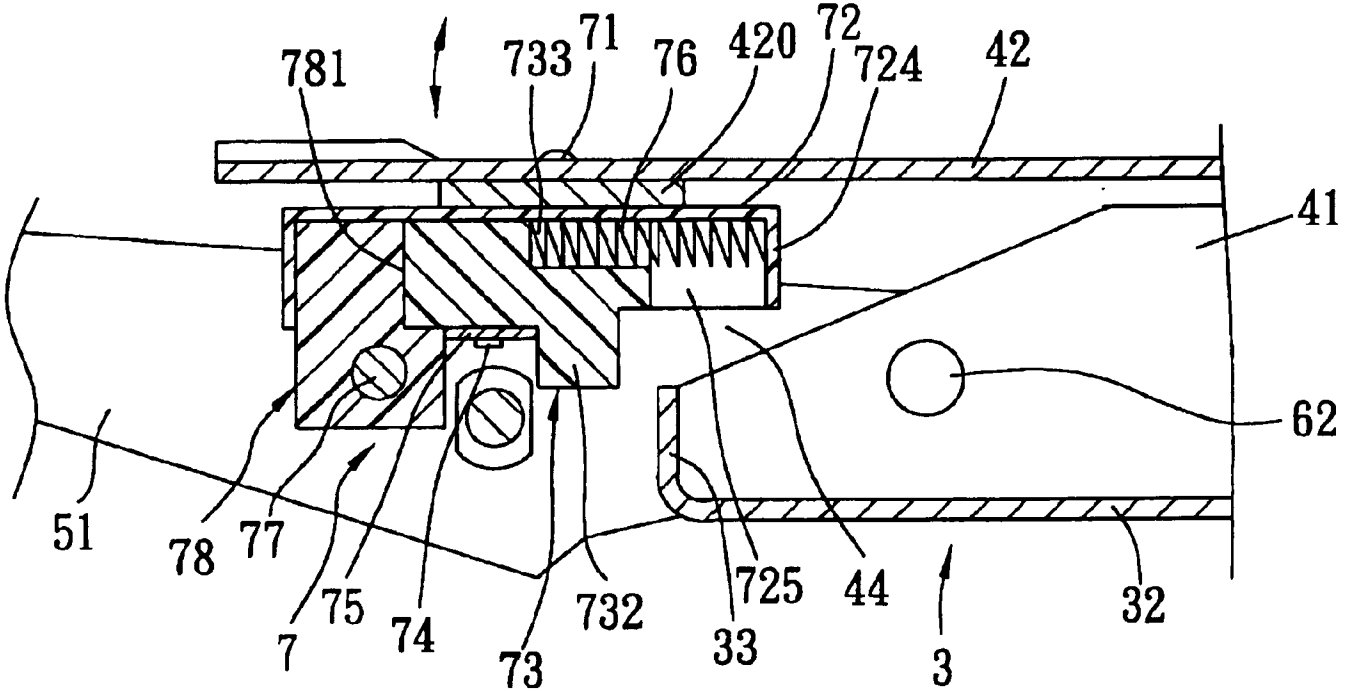
FIG. 5 is a fragmentary sectional side view of the preferred embodiment, illustrating that a slide is in a first position.
Figure 6:
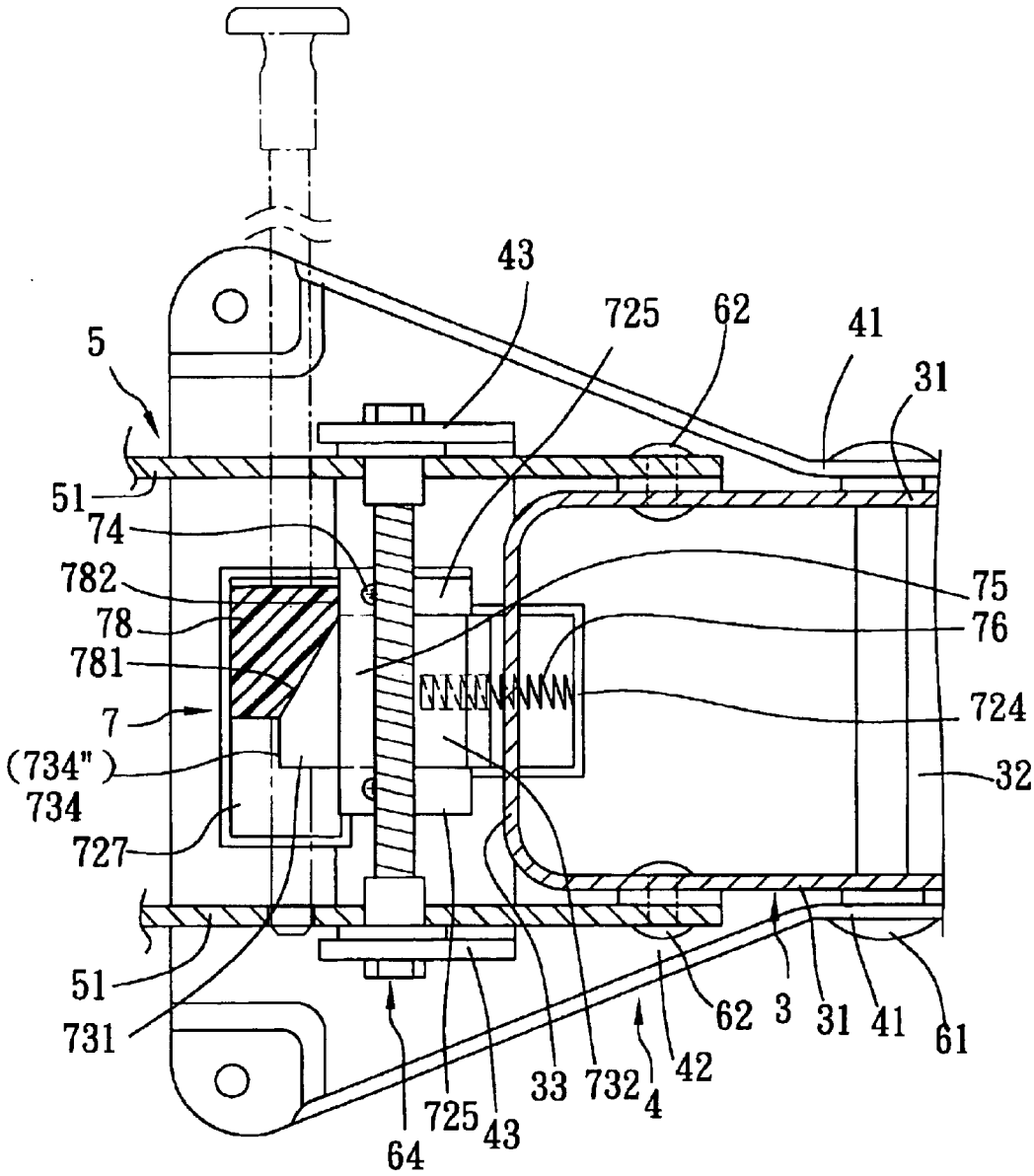
FIG. 6 is a fragmentary sectional bottom view of the preferred embodiment, illustrating that the slide is in the first position.
Figure 7:
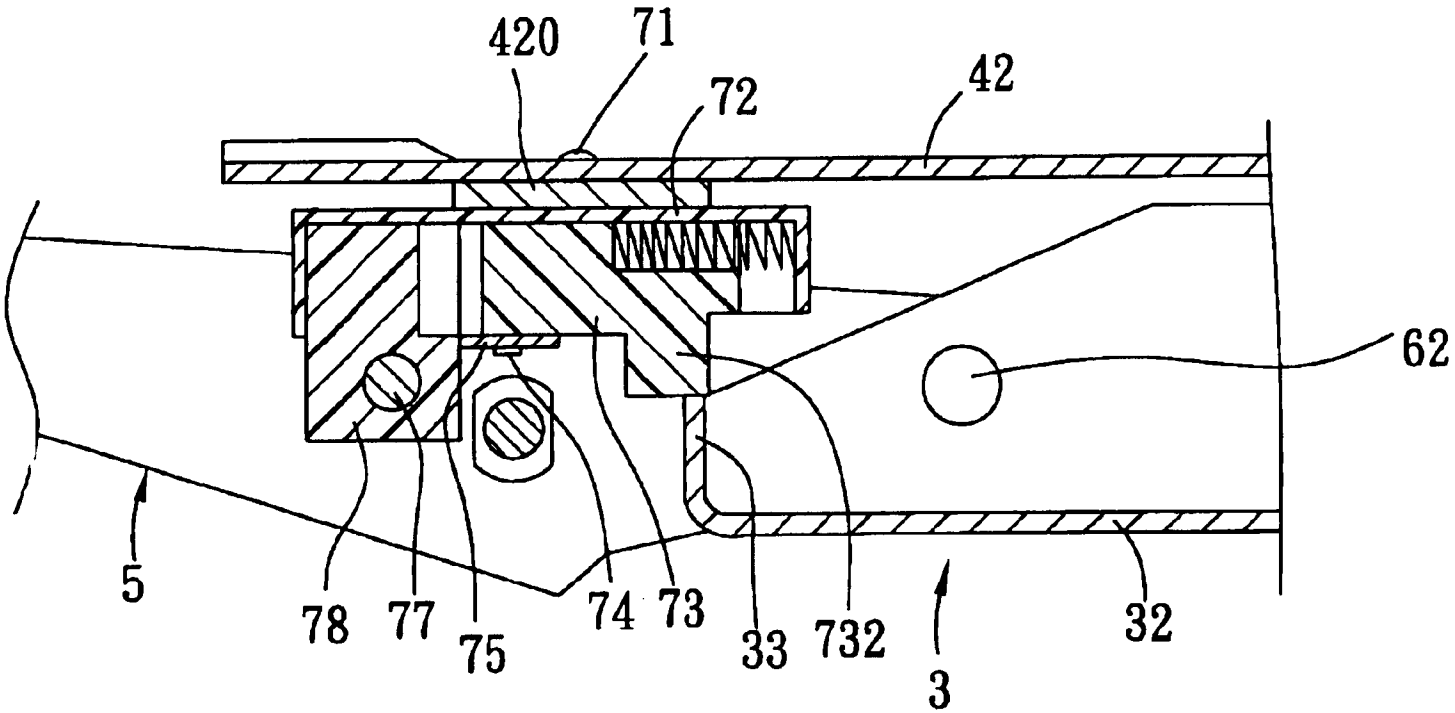
FIG. 7 is a fragmentary sectional side view of the preferred embodiment, illustrating that the slide is in a second position.

The stopping device 7 includes a slide 73, a stopping member 732, a cam mechanism, and an operating lever 77. The slide 73 is mounted slidably on the seat-mounting plate 42. The stopping member 732 projects downwardly from the slide 73. The slide 73 is slidable in the longitudinal direction between a first position, in which the stopping member 732 is offset from the rear plate 33 of the lower frame 3 in the longitudinal direction, as best shown in FIG. 5, so as to permit pivotal action of the upper frame 4 relative to the lower frame 3, and a second position, in which the stopping member 732 is aligned with the rear plate 33 of the lower frame 3 in the vertical direction so as to prevent pivoting of the upper frame 4 relative to the lower frame 3, as best shown in FIG. 7. The cam mechanism includes a cam 78 and a cam follower 734. The cam 78 is connected movably to the side plates 31 of the lower frame 3, and is movable in the transverse direction between a restricting position (see FIG. 7) and a releasing position (see FIG. 5). The cam follower 734 is formed on the slide 73, and engages the cam 78 in such a manner that movement of the cam 78 from the releasing position of FIG. 5 to the restricting position of FIG. 7 results in movement of the slide 73 from the first position to the second position, and that movement of the cam 78 from the restricting position of FIG. 7 to the releasing position of FIG. 5 results in movement of the slide 73 from the second position to the first position. In this embodiment, an urging member 76 is provided for urging constantly the slide 73 toward the first position.

A backrest-supporting frame 5 is disposed rearwardly of the lower frame 3, and includes a bottom plate 52, and two side plates 51 extending in the longitudinal direction. The side plates 51 of the backrest-supporting frame 5 are pivoted respectively to the side plates 31 of the lower frame 3 through the second pivot 62 and to two lugs 43 formed on the side plates 41 of the upper frame 4 through the third pivot 64 such that the backrest-supporting frame 5 extends rearwardly from the lower frame 3 and such that the second and third pivots 62, 64 are disposed rearwardly of and are parallel to the first pivot 61. A backrest (not shown) can be mounted on the bottom plate 52 of the backrest-supporting frame 5.

Figure 8:
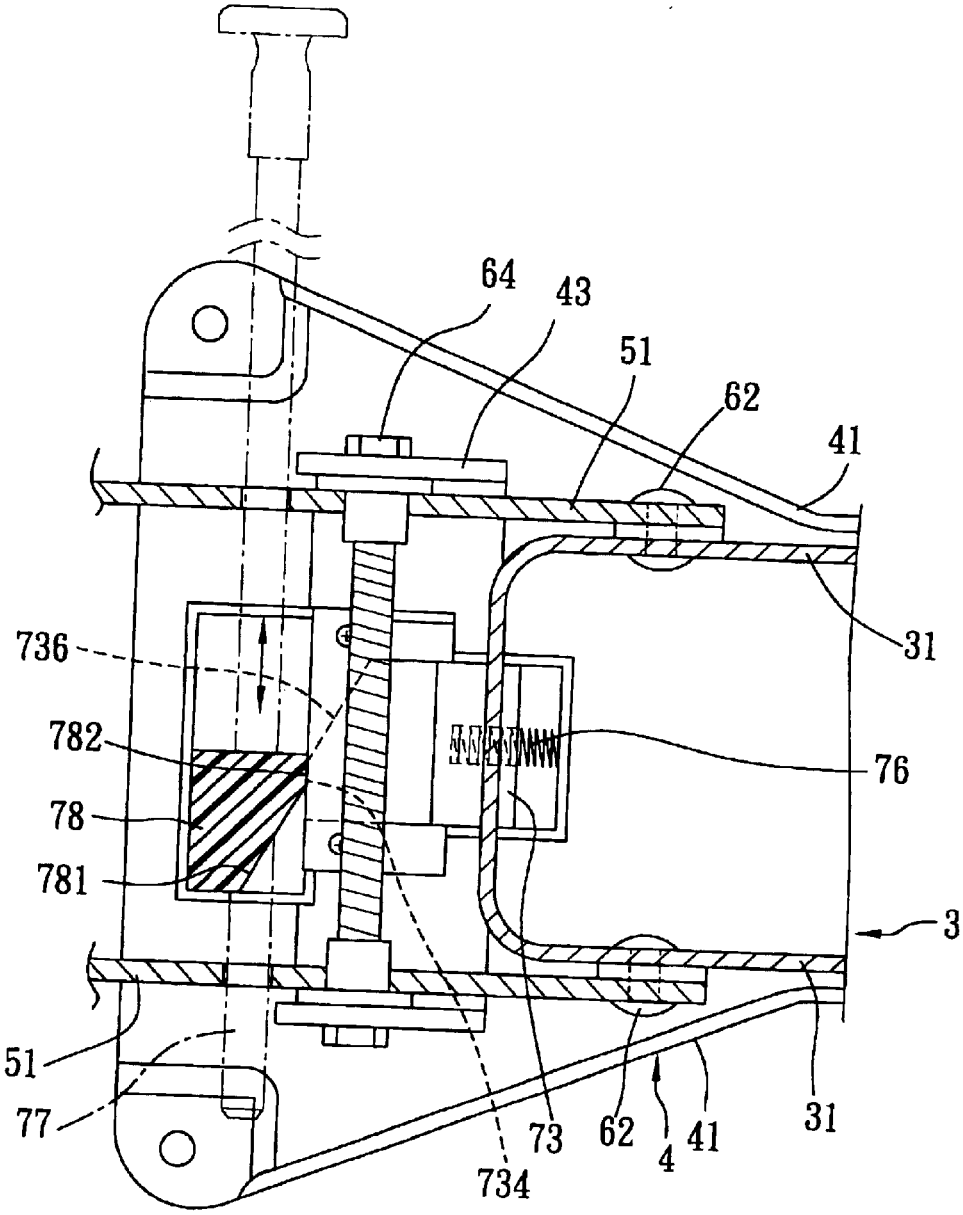
FIG. 8 is a fragmentary sectional bottom view of the preferred embodiment, illustrating that the slide is in the second position.

The operating lever 77 extends movably through the side plates 51 of the backrest-supporting frame 5, and is movable in the transverse direction. The cam 78, preferably in the form of a block 780, is mounted securely on the operating lever 77 for co-movement therewith when the operating lever 77 moves in the transverse direction. The cam 78 has an inclined face 781 which is inclined relative to the operating lever 77 and which defines a first cam face 781" and a front abutment face 782 that is parallel to the operating lever 77 and that extends from the first cam face 781". The slide 73 includes a slide body 730 that has an inclined face 736 that is inclined relative to the operating lever 77 and that defines a second cam face 736" which is in sliding contact with the first cam face 781" when the cam 78 is moved between the releasing and restricting positions by virtue of urging action of the urging member 76 (see FIG. 6), and a rear abutment face 734" that is parallel to the operating lever 77 and that extends from the second cam face 736". The cam 78 is further movable in the transverse direction from the restricting position of FIG. 5 to a stopping position of FIG. 8, in which the front abutment face 782 of the cam 78 abuts against the rear abutment face 734" of the slide body 730, thereby preventing sliding movement of the cam 78 from the stopping position to the releasing position. Under this condition, since the slide body 730 and the stopping member 732 extend concurrently into the gap 44 and abut against the seat-mounting plate 42 and the upper end 331 of the rear plate 33 of the lower frame 3, respectively, the upper frame 4 cannot be pivoted relative to the lower frame 3.

The stopping device 7 further includes a retention plate 75 and a retaining box 72 that has a bottom opening which opens downwardly and that is secured to a bottom surface of the seat-mounting plate 42 of the upper frame 4 through washers 420 and rivets 71 (see FIG. 5). The retaining box 72 defines a slide-receiving chamber 725 extending in the longitudinal direction for receiving the slide body 730 therein, and a cam-receiving chamber 727 which is enlarged from the slide-receiving chamber 725, which extends in the transverse direction, and which receives the cam 78 therein. The stopping member 732 extends downwardly and integrally from a bottom side of the slide body 730. The retaining box 72 has a front wall 724 confining a front side of the slide-receiving chamber 725. The slide body 730 has a front end 731 that is formed with a retaining recess 733, and two parallel sides 735 extending rearwardly from the front end 731 for sliding contact with two opposite sides of the slide-receiving chamber 725 when the slide body 730 slides in the slide-receiving chamber 725. The urging member 76 is mounted in the retaining recess 733, and abuts against the front wall 724 of the retaining box 72 so as to urge the slide body 730 toward the first position.

The retention plate 75 is secured to a bottom surface 721 of the retaining box 72 through two fastener screws 74, and covers partially the bottom opening in such a manner as to prevent untimely removal of the slide body 730 from the slide-receiving chamber 725.

The slide 73, the urging member 76 and the retaining box 72 can be assembled together as a module. The module is subsequently secured to the seat-mounting plate 42 of the upper frame 4 through the rivets 71. As such, assembly or disassembly of the module is relatively convenient.

By virtue of the stopping device 7 of the chair according to the present invention, the aforesaid drawbacks associated with the prior art can be eliminated.

With this invention thus explained, it is apparent that numerous modifications and variations can be made with out departing from the scope and spirit of this invention. It is therefore intended that the invention be limited only as indicated in the appended claims.

I claim:

1. A chair comprising:

a leg unit;

a lower frame having opposite front and rear ends, a base plate secured to said leg unit, spaced-apart side plates extending between said front and rear ends in a longitudinal direction, and a rear plate formed on said base plate and having an upper end;

a first pivot extending in a transverse direction relative to said longitudinal direction;

an upper frame including a seat-mounting plate disposed above said lower frame, and two side plates that extend downwardly and respectively from two opposite sides of said seat-mounting plate and that are respectively pivoted to said side plates of said lower frame through said first pivot so as to permit pivotal action of said upper frame relative to said lower frame, said seat-mounting plate being spaced apart from said upper end of said rear plate in a vertical direction that is transverse to said longitudinal and transverse directions;

an urging mechanism connected to said front end of said seat-mounting plate of said upper frame and said lower frame; and a stopping device including a slide mounted slidably on said seat-mounting plate, and a stopping member formed on said slide, said slide being slidable in said longitudinal direction between a first position, in which said stopping member is offset from said rear plate of said lower frame in said longitudinal direction, and a second position, in which said stopping member is aligned with said rear plate of said lower frame in said vertical direction for preventing pivoting of said upper frame relative to said lower frame, said stopping device further comprising a cam mechanism which includes a cam that is connected movably to said side plates of said lower frame and that is movable in said transverse direction between a releasing position and a restricting position, and a cam follower that is formed on said slide and that engages said cam in such a manner that movement of said cam from said releasing position to said restricting position results in movement of said slide from said first position to said second position, and that movement of said cam from said restricting position to said releasing position results in movement of said slide from said second position to said first position.

2. The chair as defined in claim 1, wherein said rear plate extends upwardly from said base plate of said lower frame.

3. The chair as defined in claim 1, wherein said stopping member projects downwardly from said slide.

4.The chair as defined in claim 1, further comprising an urging member for urging constantly said slide toward said first position.

5. The chair as defined in claim 4, further comprising second and third pivots, a backrest-supporting frame disposed rearwardly of said lower frame, and including two side plates extending in said longitudinal direction and pivoted respectively to said side plates of said lower frame through said second pivot and to said upper frame through said third pivot, said second and third pivots being disposed rearwardly of and being parallel to said first pivot, said stopping device further including an operating lever extending movably through said side plates of said backrest-supporting frame and movable in said transverse direction, said cam being mounted securely on said operating lever for co-movement therewith when said operating lever moves in said transverse direction, and having an inclined face which is inclined relative to said operating lever and which defines a first cam face, said slide having an inclined face that is inclined relative to said operating lever and that defines a second cam face which is in sliding contact with said first cam face by virtue of urging action of said urging member when said cam is moved between said releasing and restricting positions.

6. The chair as defined in claim 5, wherein said cam is further formed with a front abutment face that is parallel to said operating lever and that extends from said first cam face, said slide further having a rear abutment face that is parallel to said operating lever and that extends from said second cam face, said cam being further movable in said transverse direction from said restricting position to a stopping position, in which said front abutment face of said cam abuts against said rear abutment face of said slide, thereby preventing sliding movement of said cam from said stopping position to said releasing position.

7. The chair as defined in claim 6, wherein said stopping device further includes a retaining box that has a bottom opening which opens downwardly, that is secured to said seat-mounting plate of said upper frame, and that defines a slide-receiving chamber extending in said longitudinal direction and receiving said slide therein, a cam-receiving chamber enlarged from said slide-receiving chamber, extending in said transverse direction and receiving said cam therein, said retaining box having a front wall confining a front side of said slide-receiving chamber, said slide having a front end that is formed with a retaining recess, said urging member being mounted in said retaining recess and abutting against said front wall of said retaining box so as to urge said slide toward said first position.

8. The chair as defined in claim 7, wherein said stopping device further includes a retention plate secured to said retaining box and partially covering said bottom opening in said retaining box in such a manner as to prevent removal of said slide from said slide-receiving chamber.

* * * * *